US011760091B2

(12) United States Patent
Dogome

(10) Patent No.: US 11,760,091 B2
(45) Date of Patent: Sep. 19, 2023

(54) LIQUID DISCHARGE HEAD AND RECORDING APPARATUS

(71) Applicant: KYOCERA Corporation, Kyoto (JP)

(72) Inventor: Kazuki Dogome, Kirishima (JP)

(73) Assignee: KYOCERA CORPORATION, Kyoto (JP)

( * ) Notice: Subject to any disclaimer, the term of this patent is extended or adjusted under 35 U.S.C. 154(b) by 84 days.

(21) Appl. No.: 17/439,808

(22) PCT Filed: Mar. 17, 2020

(86) PCT No.: PCT/JP2020/011846
§ 371 (c)(1),
(2) Date: Sep. 16, 2021

(87) PCT Pub. No.: WO2020/189695
PCT Pub. Date: Sep. 24, 2020

(65) Prior Publication Data

US 2022/0176697 A1 Jun. 9, 2022

(30) Foreign Application Priority Data

Mar. 20, 2019 (JP) ..... 2019-053750

(51) Int. Cl.
*B41J 2/14* (2006.01)

(52) U.S. Cl.
CPC ..... *B41J 2/14145* (2013.01)

(58) Field of Classification Search
CPC ..... B41J 2/14145; B41J 2002/14225; B41J 2002/14306; B41J 2002/14362;
(Continued)

(56) References Cited

U.S. PATENT DOCUMENTS 5,752,303 A 5/1998 Thiel
2013/0076836 A1 3/2013 Yokota
2015/0224766 A1 8/2015 Kawamura et al.

FOREIGN PATENT DOCUMENTS

JP 200662260 A 3/2006
JP 200738596 A 2/2007
(Continued)

OTHER PUBLICATIONS

Machine Translation of Image Recording Method, Jul. 25, 2018, Inkjet Recording Device: Paragraphs 1-15 (Year: 2018).*
IP.com seasrch (Year: 2023).*

*Primary Examiner* — Lisa Solomon
(74) *Attorney, Agent, or Firm* — HAUPTMAN HAM, LLP

(57) ABSTRACT

A liquid discharge head includes a flow channel member including a first surface and a second surface opposite to the first surface, and a pressing unit on the first surface. The flow channel member includes a first discharge hole and a second discharge hole in the second surface, a first individual flow channel connected to the first discharge hole, a first pressurizing chamber on an upstream side of the first discharge hole in the first individual flow channel, a second individual flow channel connected to the second discharge hole, a second pressurizing chamber on an upstream side of the second discharge hole in the second individual flow channel, and a manifold commonly connected to an upstream side of first individual flow channel and an upstream side of the second individual flow channel. The first individual flow channel and the second individual flow channel have an overlapping portion in plan view.

9 Claims, 13 Drawing Sheets

(58) Field of Classification Search
CPC .... B41J 2002/14459; B41J 2002/14491; B41J 2202/11; B41J 2/14209
See application file for complete search history.

(56) References Cited

FOREIGN PATENT DOCUMENTS

| | | | |
|---|---|---|---|
| JP | 201371293 | A | 4/2013 |
| JP | 2017211151 | A | 11/2017 |
| JP | 2018202611 | A | 12/2018 |

* cited by examiner

LIQUID DISCHARGE HEAD AND RECORDING APPARATUS

CROSS-REFERENCE TO RELATED APPLICATION(S)

This application is a national stage application of International Application No. PCT/JP2020/011846, filed on Mar. 17, 2020, which designates the United States, is based upon and claims the benefit of priority to Japanese Patent Application No. 2019-053750, filed on Mar. 20, 2019.

TECHNICAL FIELD

The disclosed embodiments relate to a liquid discharge head and a recording apparatus.

BACKGROUND ART

Known printing apparatuses include inkjet printers and inkjet plotters that utilize an inkjet recording method. Such an inkjet printing apparatus has a liquid discharge head installed for discharging a liquid (see, for example, Patent Document 1).

CITATION LIST

Patent Literature

Patent Document 1: Japanese Unexamined Patent Application Publication No. 2006-62260

SUMMARY OF INVENTION

Technical Problem

However, when a large number of discharge holes are provided in a known liquid discharge head, the flow channel that supplies the liquid from the manifold to the plurality of discharge holes must be densely formed. This renders the downsizing of the head main body difficult.

An aspect of the embodiment has been made in view of the above, and an object is to provide a liquid discharge head and a recording apparatus with which a head main body can be downsized.

Solution to Problem

A liquid discharge head according to an aspect of an embodiment includes a flow channel member including a first surface and a second surface located opposite to the first surface, and a pressing unit located on the first surface. The flow channel member includes a first discharge hole and a second discharge hole located in the second surface, a first individual flow channel connected to the first discharge hole; a first pressurizing chamber located more on an upstream side than the first discharge hole in the first individual flow channel; a second individual flow channel connected to the second discharge hole; a second pressurizing chamber that is located more on an upstream side than the second discharge hole in the second individual flow channel; and a manifold commonly connected to an upstream side of first individual flow channel and an upstream side of the second individual flow channel. The first individual flow channel and the second individual flow channel have an overlapping portion in plan view.

A recording apparatus according to an aspect of an embodiment includes a liquid discharge head, a conveying unit configured to convey a recording medium to the liquid discharge head, and a control unit configured to control the liquid discharge head. The liquid discharge head includes a flow channel member including a first surface and a second surface located opposite to the first surface, and a pressing unit located on the first surface. The flow channel member includes a first discharge hole and a second discharge hole located in the second surface, a first individual flow channel connected to the first discharge hole; a first pressurizing chamber located more on an upstream side than the first discharge hole in the first individual flow channel; a second individual flow channel connected to the second discharge hole; a second pressurizing chamber that is located more on an upstream side than the second discharge hole in the second individual flow channel; and a manifold commonly connected to an upstream side of the first individual flow channel and an upstream side of the second individual flow channel. The first individual flow channel and the second individual flow channel have an overlapping portion in plan view.

Advantageous Effects of Invention

According to an aspect of the embodiment, a liquid discharge head and a recording device with which a head main body can be downsized can be provided.

DESCRIPTION OF EMBODIMENTS

Embodiments of a liquid discharge head and a recording apparatus disclosed in the present application will be described in detail below with reference to the accompanying drawings. Note that the present invention is not limited by the embodiments described below.

Known printing apparatuses include inkjet printers and inkjet plotters that utilize an inkjet recording method. An inkjet printing apparatus is installed with a liquid discharge head for discharging a liquid.

A piezoelectric method is another method for discharging liquid from the liquid discharge head. A liquid discharge head for the piezoelectric method discharges ink in an ink flow channel by mechanically pressurizing the ink with a part of the wall of the ink flow channel bent and displaced by a displaced element.

However, when a large number of discharge holes are provided in a known liquid discharge head, the flow channel that supplies the liquid from the manifold to the plurality of discharge holes must be densely formed. This renders the downsizing of the head main body difficult.

On the other hand, reducing the number of discharge holes in order to downsize the head main body results in a problem in that the resolution of the printing apparatus is compromised.

Thus, there has been a demand for a liquid discharge head and a recording apparatus with which a head main body can be downsized even when a large number of discharge holes are provided.

Printer Configuration

Figure 1:
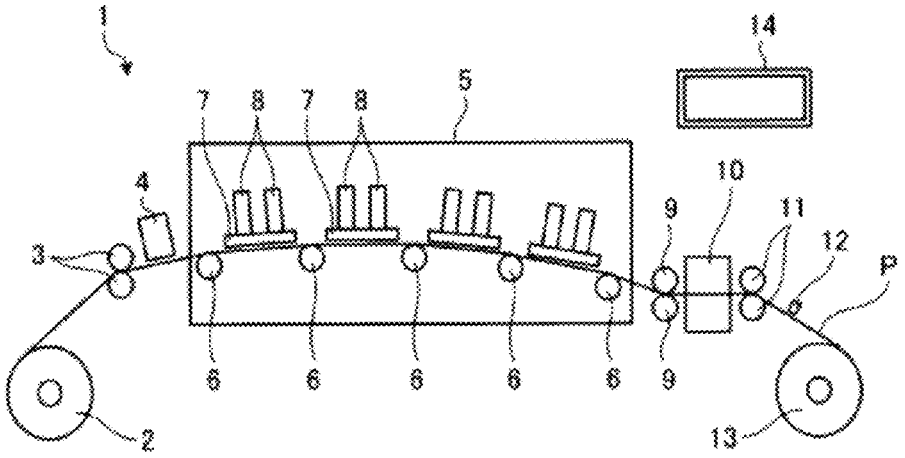
FIG. 1 is an explanatory view (1) of a recording apparatus according to an embodiment.
Figure 2:
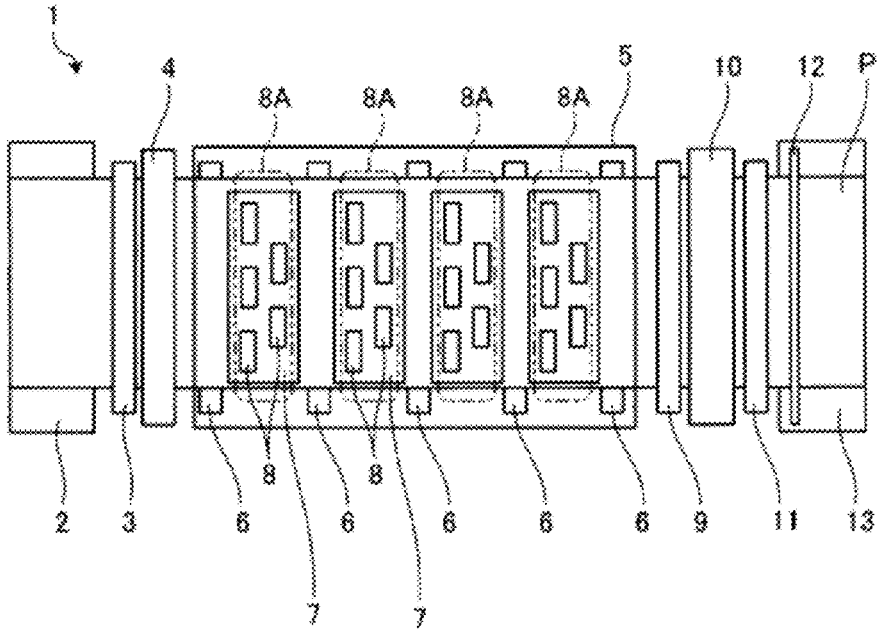
FIG. 2 is an explanatory view (2) of the recording apparatus according to the embodiment.

First, a description will be given on an overview of a printer 1 that is one example of a recording apparatus according to an embodiment, with reference to FIG. 1 and FIG. 2. FIGS. 1 and 2 are explanatory views of the printer 1 according to the embodiment.

Specifically, FIG. 1 is a schematic side view of the printer 1 and FIG. 2 is a schematic plan view of the printer 1. The printer 1 according to the embodiment is, for example, a color inkjet printer.

As illustrated in FIG. 1, the printer 1 includes a paper feed roller 2, guide rollers 3, an applicator 4, a head case 5, a plurality of conveying rollers 6, a plurality of frames 7, a plurality of liquid discharge heads 8, conveying rollers 9, a dryer 10, conveying rollers 11, a sensor unit 12, and a collection roller 13. The conveying rollers 6 are examples of a conveying unit.

The printer 1 includes a control unit 14 that controls the paper feed roller 2, the guide rollers 3, the applicator 4, the head case 5, the plurality of conveying rollers 6, the plurality of frames 7, the plurality of liquid discharge heads 8, the conveying rollers 9, the dryer 10, the conveying rollers 11, the sensor unit 12, and the collection roller 13.

The printer 1 records an image and characters on a printing sheet P by causing droplets to land on the printing sheet P. The printing sheet P is an example of a recording medium. The printing sheet P is rolled on the paper feed roller 2 prior to use. In this state, the printer 1 conveys the printing sheet P from the paper feed roller 2 to the inside of the head case 5 via the guide rollers 3 and the applicator 4.

The applicator 4 uniformly applies a coating agent over the printing sheet P. With surface treatment thus performed on the printing sheet P, the printing quality of the printer 1 can be improved.

The head case 5 houses the plurality of conveying rollers 6, the plurality of frames 7, and the plurality of liquid discharge heads 8. The inside of the head case 5 is formed with a space separated from the outside except for a part connected to the outside such as parts where the printing sheet P enters and exits.

If necessary, the control unit 14 controls at least one of controllable factors of the internal space of the head case 5, such as the temperature, the humidity, and barometric pressure. The conveying rollers 6 convey the printing sheet P to the vicinity of the liquid discharge heads 8, inside the head case 5.

The frame 7 is a rectangular flat plate, and is positioned above and close to the printing sheet P conveyed by the conveying rollers 6. As illustrated in FIG. 2, the frames 7 are positioned such that the longitudinal direction of the frames 7 is orthogonal to the conveyance direction of the printing sheet P. Furthermore, the plurality of (e.g., four) frames 7 are located inside the head case 5 along the conveyance direction of the printing sheet P.

Liquid, which is ink for example, is supplied to the liquid discharge heads 8 from a liquid tank (not illustrated). Each liquid discharge head 8 discharges the liquid supplied from the liquid tank.

The control unit 14 controls the liquid discharge heads 8 based on data of an image, characters, and the like to discharge the liquid toward the printing sheet P. The distance between each liquid discharge head 8 and the printing sheet P is, for example, approximately 0.5 to 20 mm.

The liquid discharge heads 8 are fixed to the frame 7. The liquid discharge heads 8 are positioned such that the longitudinal direction of the liquid discharge heads 8 is orthogonal to the conveyance direction of the printing sheet P.

That is, the printer 1 according to the embodiment is what is known as a line printer with the liquid discharge heads 8 fixed inside the printer 1. Note that the printer 1 according to the embodiment is not limited to a line printer and may also be what is known as a serial printer.

The serial printer is a printer employing a method of alternately performing operations of recording while moving the liquid discharge heads 8 in a manner such as reciprocation in a direction intersecting (e.g., substantially orthogonal to) the conveyance direction of the printing sheet P, and conveying the printing sheet P.

As illustrated in FIG. 2, a plurality of (e.g., five) liquid discharge heads 8 are fixed to one frame 7. FIG. 2 illustrates an example in which three liquid discharge heads 8 are located on the forward side and two liquid discharge heads 8 are located on the rear side, in the conveyance direction of the printing sheet P. Further, the liquid discharge heads 8 are positioned without their centers overlapping in the conveyance direction of the printing sheet P.

The plurality of liquid discharge heads 8 positioned in one frame 7 form a head group 8A. Four head groups 8A are positioned along the conveyance direction of the printing sheet P. The liquid discharge heads 8 belonging to the same head group 8A are supplied with ink of the same color. As a result, the printer 1 can perform printing with four colors of ink using the four head groups 8A.

The colors of the ink discharged from the respective head groups 8A are, for example, magenta (M), yellow (Y), cyan (C), and black (K). The control unit 14 can print a color image on the printing sheet P by controlling each of the head groups 8A to discharge the plurality of colors of ink onto the printing sheet P.

Note that a surface treatment may be performed on the printing sheet P, by discharging a coating agent from the liquid discharge head 8 onto the printing sheet P.

Furthermore, the number of the liquid discharge heads 8 included in one head group 8A and the number of the head groups 8A provided in the printer 1 can be changed as appropriate in accordance with printing targets and printing conditions. For example, if the color to be printed on the printing sheet P is a single color and the range of the printing can be covered by a single liquid discharge head 8, only a single liquid discharge head 8 may be provided in the printer 1.

The printing sheet P thus subjected to the printing process inside the head case 5 is conveyed by the conveying rollers 9 to the outside of the head case 5, and passes through the inside of the dryer 10. The dryer 10 dries the printing sheet P after the printing process. The printing sheet P thus dried by the dryer 10 is conveyed by the conveying rollers 11 and then collected by the collection roller 13.

In the printer 1, by drying the printing sheet P with the dryer 10, it is possible to suppress bonding between the printing sheets P rolled while being overlapped with each other, and rubbing between undried liquid at the collection roller 13.

The sensor unit 12 includes a position sensor, a speed sensor, a temperature sensor, and the like. Based on information from the sensor unit 12, the control unit 14 can determine the state of each part of the printer 1 and control each part of the printer 1.

In the printer 1 described above, the printing sheet P is the printing target (i.e., the recording medium), but the printing target in the printer 1 is not limited to the printing sheet P, and a roll type fabric or the like may be the printing target.

Furthermore, instead of directly conveying the printing sheet P, the printer 1 may be mounted on a conveyor belt and then conveyed. If a conveyor belt is used, the printing target of the printer 1 can be flat paper, cut cloth, wood, tile, or the like.

Furthermore, the printer 1 may discharge a liquid containing electrically conductive particles from the liquid discharge head 8, to print a wiring pattern or the like of an electronic device. Furthermore, the printer 1 may discharge liquid containing a predetermined amount of liquid chemical agent or liquid containing the chemical agent from the liquid discharge head 8 onto a reaction vessel or the like to produce chemicals.

The printer 1 may also include a cleaning unit for cleaning the liquid discharge heads 8. The cleaning unit cleans the liquid discharge heads 8 by, for example, a wiping process or a capping process.

The wiping process is, for example, a process of removing liquid attached to a second surface 24*b* (see FIG. 3) of a flow channel member 24 (see FIG. 3), which is an example of a surface of a portion onto which the liquid is discharged, by rubbing the second surface 24*b* with a flexible wiper.

The capping process is performed as follows, for example. First of all, a cap is provided to cover the second surface 24*b* of the flow channel member 24 which is an example of the portion onto which the liquid is discharged (this action is referred to as capping). As a result, a substantially sealed space is formed between the second surface 24*b* and the cap.

The discharge of liquid is then repeated in such a sealed space. As a result, liquid with a viscosity higher than that in the normal state, foreign matter, or the like clogging a first discharge hole 45 (see FIG. 5) and a second discharge hole 55 (see FIG. 5) can be removed.

Configuration of Liquid Discharge Head

Figure 3:
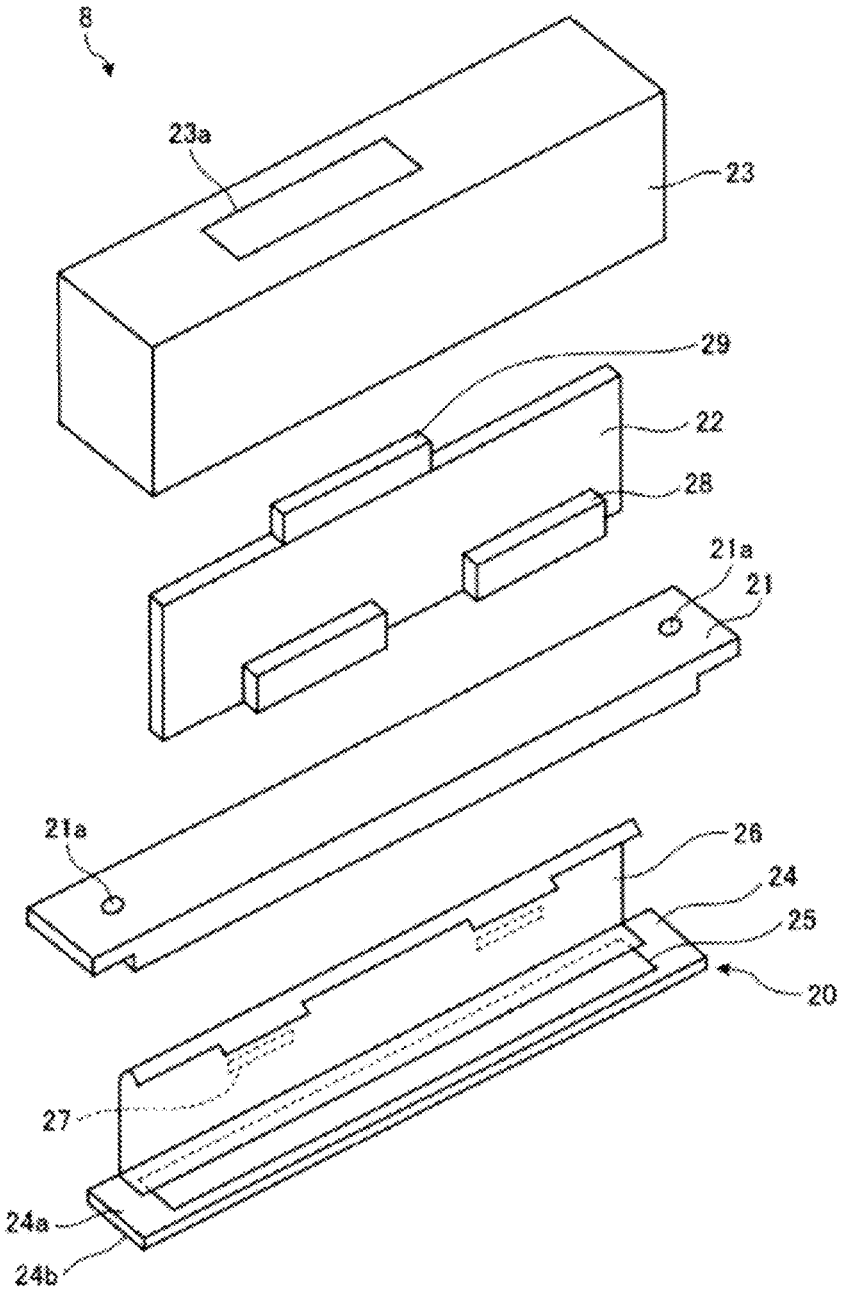
FIG. 3 is an exploded perspective view illustrating a schematic configuration of a liquid discharge head according to the embodiment.

Next, the configuration of the liquid discharge head 8 according to the embodiment will be described with reference to FIG. 3. FIG. 3 is an exploded perspective view illustrating a schematic configuration of the liquid discharge head 8 according to the embodiment.

As illustrated in FIG. 3, the liquid discharge head 8 includes a head main body 20, a reservoir 21, an electrical board 22, and a head cover 23. The head main body 20 includes the flow channel member 24, a piezoelectric actuator substrate 25, a signal transmission unit 26, and a drive IC 27.

The flow channel member 24 of the head main body 20 has a substantially flat plate shape and includes a first surface 24*a*, which is one main surface, and the second surface 24*b* located opposite to the first surface 24*a*. The first surface 24*a* has an opening 40*a* (see FIG. 4), and a liquid is supplied into the flow channel member 24 from the reservoir 21 through the opening 40*a*.

A plurality of the first discharge holes 45 (see FIG. 4) and a plurality of the second discharge holes 55 (see FIG. 4) through which liquid is discharged onto the printing sheet P are located in the second surface 24*b*. Furthermore, a flow channel through which liquid flows from the first surface 24*a* to the second surface 24*b* is formed inside the flow channel member 24. Details of the flow channel member 24 will be described later.

The piezoelectric actuator substrate 25 is located on the first surface 24*a* of the flow channel member 24. The piezoelectric actuator substrate 25 includes a plurality of displaced elements 38 (see FIG. 5). The displaced elements 38 are examples of a pressing unit. The piezoelectric actuator substrate 25 will be described in detail later.

Two signal transmission units 26 are electrically connected to the piezoelectric actuator substrate 25. Each signal transmission unit 26 includes a plurality of the drive integrated circuits (ICs) 27. Note that, in FIG. 3, one of the signal transmission units 26 is omitted for ease of understanding.

The signal transmission unit 26 supplies a signal to each displaced element 38 of the piezoelectric actuator substrate 25. The signal transmission unit 26 is formed of, for example, a flexible printed circuit (FPC) or the like.

The drive IC 27 is provided in the signal transmission unit 26. The drive IC 27 controls the driving of each displaced element 38 in the piezoelectric actuator substrate 25.

Note that the head main body 20 has a discharge surface from which the liquid is discharged and an opposite surface located on a side opposite to the discharge surface. In the following description, the discharge surface is described as the second surface 24*b* of the flow channel member 24 and the opposite surface is described as the first surface 24*a* of the flow channel member 24.

The reservoir 21 is located on the opposite surface side of the head main body 20 and is in contact with the first surface 24*a* excluding the piezoelectric actuator substrate 25. The reservoir 21 has a flow channel therein, and is supplied with liquid from the outside through an opening 21*a*. The reservoir 21 has a function of supplying liquid to the flow channel member 24 and a function of storing the liquid to be supplied.

The electrical board 22 is provided in a standing manner on a surface on the side of the reservoir 21 opposite to the head main body 20. A plurality of connectors 28 are located on an end portion of the electrical board 22 on the reservoir 21 side. An end portion of the signal transmission unit 26 is housed in each connector 28.

Connectors 29 for power supply are located on an end portion of the electrical board 22 on the side opposite to the reservoir 21. The electrical board 22 distributes current, supplied from the outside via the connector 29, to the connectors 28 and supplies the current to the signal transmission unit 26.

The head cover 23 is located on the opposite surface side of the head main body 20 and covers the signal transmission unit 26 and the electrical board 22. Thus, the liquid discharge heads 8 can seal the signal transmission unit 26 and the electrical board 22.

The head cover 23 includes an opening 23*a*. The connector 29 of the electrical board 22 is inserted to be exposed to the outside, through the opening 23*a*.

The drive IC 27 is in contact with an interior side surface of the head cover 23. The drive IC 27 is pressed against the interior side surface of the head cover 23, for example. As a result, heat generated by the drive IC 27 can be dissipated (radiated) through a contact portion on the side surface of the head cover 23.

Note that the liquid discharge head 8 may further include a member other than the member illustrated in FIG. 3.

Configuration of Head Main Body

Figure 4:
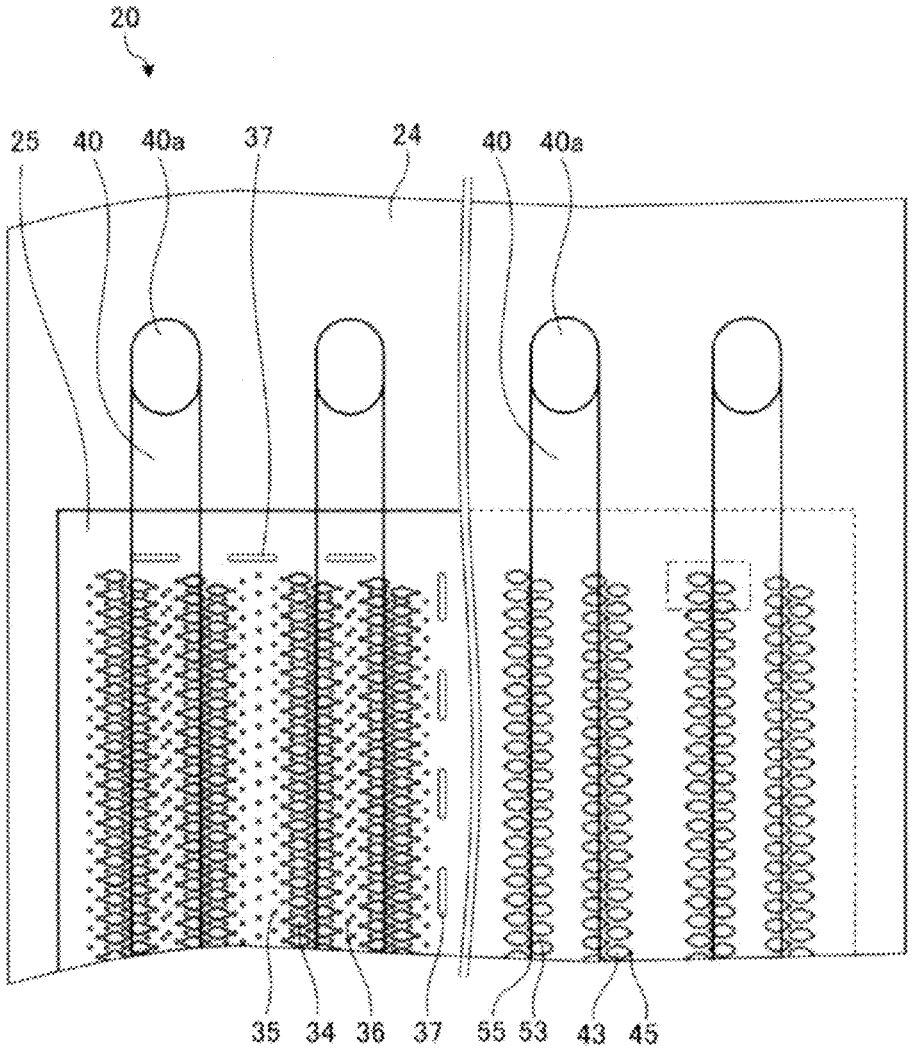
FIG. 4 is an enlarged plan view of a part of a head main body according to the embodiment.
Figure 5:
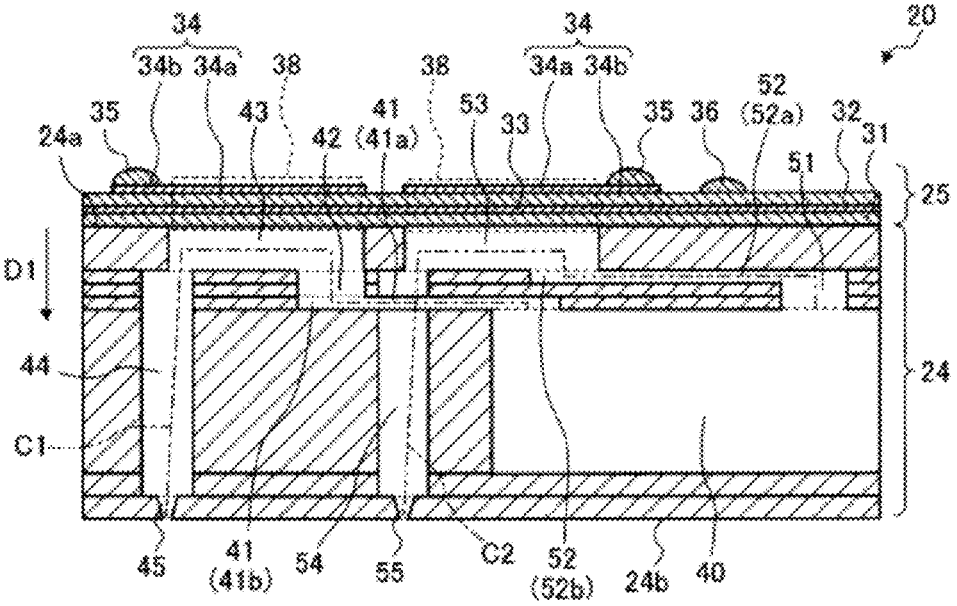
FIG. 5 is a schematic cross-sectional view of a region surrounded by a dot-dash line illustrated in FIG. 4.
Figure 6:
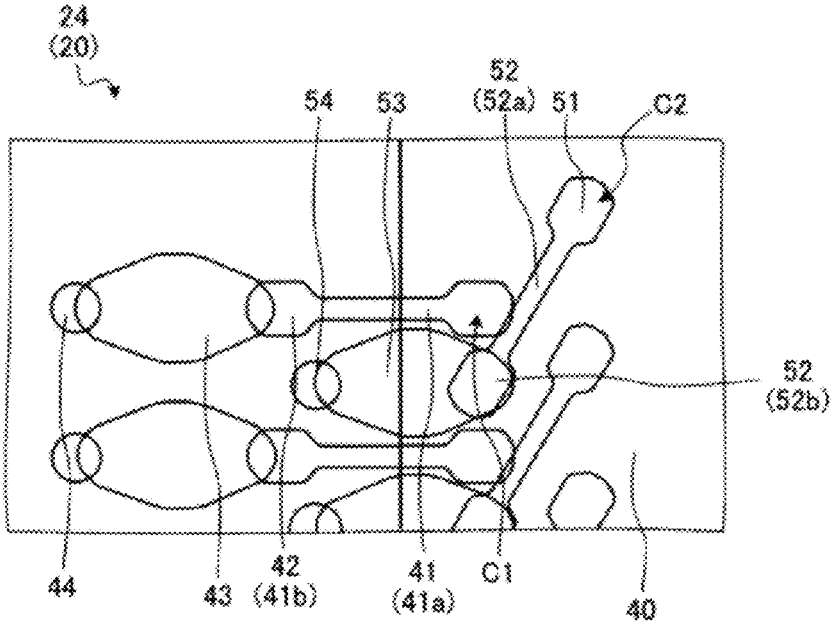
FIG. 6 is an enlarged plane perspective view of the region surrounded by the dot-dash line illustrated in FIG. 4.

Next, the configuration of the head main body 20 according to the embodiment will be described with reference to FIGS. 4 to 6. FIG. 4 is an enlarged plan view of a part of the head main body 20 according to the embodiment, FIG. 5 is a schematic cross-sectional view of a region surrounded by a dot-dash line illustrated in FIG. 4, and FIG. 6 is an enlarged plane perspective view of the region surrounded by the dot-dash line illustrated in FIG. 4.

As illustrated in FIG. 4, the head main body 20 includes the flow channel member 24 and the piezoelectric actuator substrate 25. The flow channel member 24 includes a supply manifold 40, a plurality of first pressurizing chambers 43, a plurality of second pressurizing chambers 53, the plurality of first discharge holes 45, and the plurality of second discharge holes 55. The supply manifold 40 is one example of a manifold.

The plurality of first pressurizing chambers 43 and the plurality of second pressurizing chambers 53 are connected to the supply manifold 40. The plurality of first discharge holes 45 are connected to the plurality of respective first pressurizing chambers 43. The plurality of second discharge holes 55 are connected to the plurality of respective second pressurizing chambers 53.

The first pressurizing chambers 43 and the second pressurizing chambers 53 open to the first surface 24*a* (see FIG. 5) of the flow channel member 24. Furthermore, the first surface 24*a* of the flow channel member 24 has the opening 40*a* that is connected to the supply manifold 40. Liquid is supplied from the reservoir 21 (see FIG. 2) to the inside of the flow channel member 24 through the opening 40*a*.

In the example illustrated in FIG. 4, the head main body 20 has four supply manifolds 40 located inside the flow channel member 24. The supply manifold 40 has an elongated shape extending along the longitudinal direction of the flow channel member 24. The opening 241*a* is located in the first surface 24*a* of the flow channel member 24 at either end of the supply manifold 40.

The plurality of first pressurizing chambers 43 and the plurality of second pressurizing chambers 53 are formed in the flow channel member 24 in a two-dimensionally spreading manner. The first pressurizing chambers 43 and the second pressurizing chambers 53 are hollow regions having a substantially diamond-shaped planar shape with rounded corners. The first pressurizing chambers 43 and the second pressurizing chambers 53 open to the first surface 24*a* of the flow channel member 24, and are closed when the piezoelectric actuator substrate 25 is joined to the first surface 24*a*.

The first pressurizing chambers 43 form a first pressurizing chamber row arranged in the longitudinal direction, and the second pressurizing chambers 53 form a second pressurizing chamber row arranged in the longitudinal direction. The first pressurizing chambers 43 belonging to the first pressurizing chamber row and the second pressurizing chambers 53 belonging to the second pressurizing chamber row adjacent to the first pressurizing chamber row are alternately arranged.

One pressurizing chamber group includes two rows of first pressurizing chamber rows and two rows of second pressurizing chamber rows connected to one supply manifold 40. In the example illustrated in FIG. 4, the flow channel member 24 includes four pressurizing chamber groups.

Moreover, the relative arrangement of the first pressurizing chambers 43 and the second pressurizing chambers 53 is the same among the pressurizing chamber groups, with the pressurizing chamber groups arranged while being slightly shifted from each other in the longitudinal direction.

The first discharge holes 45 and the second discharge holes 55 are disposed at positions outside regions, of the flow channel member 24, facing the supply manifold 40. Thus, none of the first discharge holes 45 and the second discharge holes 55 overlap with the supply manifold 40 in a plane perspective of the flow channel member 24 as viewed from the first surface 24*a* side.

Furthermore, in plan view, the first discharge holes 45 and the second discharge holes 55 are disposed within a region in which the piezoelectric actuator substrate 25 is mounted. One group of the first discharge holes 45 and the second discharge holes 55 occupies a region of approximately the same size and shape as the piezoelectric actuator substrate 25.

Droplets are discharged through the first discharge holes 45 and the second discharge holes 55 by displacing the displaced elements 38 (see FIG. 5) of the corresponding piezoelectric actuator substrate 25.

As illustrated in FIG. 5, the supply manifold 40 and the first discharge holes 45 are connected to each other via a first aperture 41, the first connection flow channel 42, the first pressurizing chamber 43, and a first vertical flow channel 44.

In other words, the flow channel member 24 includes a first individual flow channel C1 including the first aperture 41, the first connection flow channel 42, the first pressurizing chamber 43, and the first vertical flow channel 44. In the first individual flow channel C1, the first aperture 41 is located close to the supply manifold 40 and the first vertical flow channel 44 is located close to the first discharge holes 45, in the flow direction of the liquid.

Note that when a direction from the first surface 24*a* toward the second surface 24*b* is defined as a first direction D1, the first aperture 41 extends in a direction perpendicular to the first direction D1, the first connection flow channel 42 extends in the first direction D1, the first pressurizing chamber 43 extends in a direction perpendicular to the first direction D1, and the first vertical flow channel 44 extends in the first direction D1.

Similarly, the supply manifold 40 and the second discharge holes 55 are connected to each other via a second connection flow channel 51, a second aperture 52, the second pressurizing chamber 53, and a second vertical flow channel 54.

In other words, the flow channel member 24 includes a second individual flow channel C2 including the second connection flow channel 51, the second aperture 52, the second pressurizing chamber 53, and the second vertical flow channel 54. In the second individual flow channel C2, the second connection flow channel 51 is located close to the supply manifold 40 and the second vertical flow channel 54 is located close to the second discharge hole 55, in the flow direction of the liquid.

The second connection flow channel 51 extends in the first direction D1, the second aperture 52 extends in a direction perpendicular to the first direction D1, the second pressurizing chamber 53 extends in the direction perpendicular to the first direction D1, and the second vertical flow channel 54 extends in the first direction D1.

The first individual flow channel C1 has the first aperture 41 provided more on the upstream side than the first pressurizing chamber 43. In addition, the first aperture 41 includes a narrow portion 41*a* that is narrower than other portions of the first individual flow channel C1 and a wide portion 41*b* that is formed on the same plane as the narrow portion 41*a* and is wider than the narrow portion 41*a*.

With the narrow portion 41*a* that is narrower than the other portions of the first individual flow channel C1, the first aperture 41 has a high flow channel resistance.

As a result, in the embodiment, the pressure generated in the first pressurizing chamber 43 can be prevented from escaping to the supply manifold 40, instead of being directed to the first discharge holes 45. Therefore, according to the embodiment, the liquid can be efficiently discharged from the first discharge holes 45.

The second individual flow channel C2 has the second aperture 52 provided more on the upstream side than the second pressurizing chamber 53. In addition, the second aperture 52 includes a narrow portion 52*a* that is narrower than other portions of the second individual flow channel C2 and a wide portion 52*b* that is formed on the same plane as the narrow portion 52*a* and is wider than the narrow portion 52*a*.

With the narrow portion 52*a* that is narrower than the other portions of the second individual flow channel C2, the second aperture 52 has a high flow channel resistance.

As a result, in the embodiment, the pressure generated in the second pressurizing chamber 53 can be prevented from escaping to the supply manifold 40, instead of being directed to the second discharge holes 55. Therefore, according to the embodiment, the liquid can be efficiently discharged from the second discharge holes 55.

As illustrated in FIG. 5, the flow channel member 24 has a stacked structure in which a plurality of plates are stacked. A large number of holes are formed in these plates, and the supply manifold 40, the first individual flow channel C1, and the second individual flow channel C2 are formed inside the flow channel member 24, with the large number of holes connected to each other.

In the embodiment, by setting the thickness of these plates to about 10 to 300 μm, the holes can be formed with increased accuracy.

Furthermore, in the embodiment, the first aperture 41 is connected to the first connection flow channel 42 at the wide portion 41*b*. With this configuration, when the plurality of plates are stacked and the first aperture 41 and the first connection flow channel 42 are connected to each other, variations in the flow path resistance caused by misalignment can be reduced.

Furthermore, in the embodiment, the second aperture 52 is connected to the second pressurizing chamber 53 at the wide portion 52*b*. With this configuration, when the plurality of plates are stacked and the second aperture 52 and the second pressurizing chamber 53 are connected to each other, variations in the flow path resistance caused by misalignment can be reduced.

In the embodiment, as illustrated in FIG. 6, the first individual flow channel C1 and the second individual flow channel C2 have an overlapping portion in plan view. For example, in the embodiment, the first aperture 41 of the first individual flow channel C1 and the second aperture 52 of the second individual flow channel C2 have an overlapping portion in plan view.

In other words, in the embodiment, the first individual flow channel C1 and the second individual flow channel C2 have an overlapping portion in plan view that are disposed at different heights. As a result, the first individual flow channel C1 and the second individual flow channel C2 can be formed in the flow channel member 24 with high space efficiency.

Thus, according to the embodiment, even when a large number of the first discharge holes 45 and the second discharge holes 55 are provided, the flow channel member 24 can be downsized, whereby the head main body 20 can be downsized.

In particular, when the first aperture 41 and the second aperture 52 are formed in the same plane in a direction intersecting the first direction D1, the flow channel member 24 increases in size. On the other hand, as in the embodiment, when the first aperture 41 and the second aperture 52 are located vertically while having an overlapping portion in plan view, the first aperture 41 and the second aperture 52 are formed with high space efficiency, whereby the head main body 20 can be downsized.

In the embodiment, in plan view, preferably, the first pressurizing chamber 43 is located farther from the supply manifold 40 than the second pressurizing chamber 53, and the second aperture 52 is located closer to the first surface 24*a* than the first aperture 41.

With this configuration, the first aperture 41 can be disposed in the flow channel member 24 without interfering with the second pressurizing chamber 53. Thus, according to the embodiment, the first individual flow channel C1 can be formed in the flow channel member 24 with even higher space efficiency.

Additionally, in the embodiment, the volume of the second pressurizing chamber 53 is preferably larger than the volume of the first pressurizing chamber 43. As illustrated in FIG. 5, the first connection flow channel 42 is directly connected to the first pressurizing chamber 43, but the second connection flow channel 51 is not directly connected to the second pressurizing chamber 53. Therefore, the substantial volume of the first pressurizing chamber 43 (the sum of the volume of the first pressurizing chamber 43 and the volume of the first connection flow channel 42) is larger than the volume of the second pressurizing chamber 53 by an amount corresponding to the volume of the first connection flow channel 42.

Thus, in the embodiment, because the volume of the second pressurizing chamber 53 is set to be larger than the volume of the first pressurizing chamber 43, it is possible to equalize the substantial volume of the second pressurizing chamber 53 with the substantial volume of the first pressurizing chamber 43, which are the volumes of the first pressurizing chamber 43 and the first connection flow channel 42.

With the substantial volume of the first pressurizing chamber 43 equalized with the substantial volume of the second pressurizing chamber 53, the characteristics of discharging as a result of application of pressure from the displaced elements 38 to the first pressurizing chamber 43 can be equalized with the characteristics of discharging as a result of application of pressure to the second pressurizing chamber 53 from the displaced elements 38.

Thus, with the embodiment, the printing quality of the printer 1 can be improved.

A description will be further given on other portions of the head main body 20. As illustrated in FIG. 5, the piezoelectric actuator substrate 25 includes piezoceramic layers 31 and 32, a common electrode 33, an individual electrode 34, a connection electrode 35, a dummy electrode 36, and a surface electrode 37 (see FIG. 4).

The piezoelectric actuator substrate 25 includes the piezoceramic layer 31, the common electrode 33, the piezoceramic layer 32, and the individual electrode 34 stacked in this order.

Each of the piezoceramic layers 31 and 32 extends across the plurality of first pressurizing chambers 43 and second pressurizing chambers 53. The piezoceramic layers 31 and 32 each have a thickness of approximately 20 μm. The piezoceramic layers 31 and 32 may be made of a ferroelectric lead zirconate titanate (PZT)-based ceramic material.

The common electrode 33 is formed substantially over the entire surface in the region between the piezoceramic layer 31 and the piezoceramic layer 32 in a surface direction. Thus, the common electrode 33 overlaps all of the first pressurizing chambers 43 and the second pressurizing chambers 53 in the region facing the piezoelectric actuator substrate 25.

The thickness of the common electrode 33 is approximately 2 μm. A metal material such as a Ag—Pd based material can be used for the common electrode 33.

The individual electrode 34 includes a main body electrode 34*a* and an extraction electrode 34*b*. The main body electrode 34*a* is located in a region, on the piezoceramic layer 32, facing the first pressurizing chambers 43 and the second pressurizing chambers 53. The main body electrode 34*a* is one size smaller than each first pressurizing chamber 43 and each second pressurizing chamber 53, and has a shape substantially similar to that of the first pressurizing chamber 43 and the second pressurizing chamber 53.

The extraction electrode 34*b* is extracted from the main body electrode 34*a* to be outside the region facing the first pressurizing chambers 43 and the second pressurizing chambers 53. A metal material such as a Au based material can be used for the individual electrode 34.

The connection electrode 35 is located on the extraction electrode 34*b*, and is formed to have a protruding shape with a thickness of approximately 15 μm. The connection electrode 35 is electrically connected to an electrode provided to the signal transmission unit 26 (see FIG. 3). The connection electrode 35 is formed of, for example, silver-palladium, including glass frit.

The dummy electrode 36 is located on the piezoceramic layer 32 and is located so as not to overlap various electrodes such as the individual electrode 34. The dummy electrode 36 connects the piezoelectric actuator substrate 25 and the signal transmission unit 26 to each other, and increases the connection strength.

Furthermore, the dummy electrode 36 uniformizes the distribution of the contact positions between the piezoelectric actuator substrate 25 and the signal transmission unit 26, and stabilizes the electrical connection. The dummy electrode 36 is preferably made of a material equivalent to that of the connection electrode 35, and is preferably formed in a process equivalent to that of the connection electrode 35.

The surface electrode 37 illustrated in FIG. 4 is formed on the piezoceramic layer 32 at a position not interfering with the individual electrodes 34. The surface electrode 37 is connected to the common electrode 33 through a via hole formed in the piezoceramic layer 32.

Thus, the surface electrode 37 is grounded and maintained at the ground potential. The surface electrode 37 is preferably made of a material equivalent to that of the individual electrode 34, and is preferably formed in a process equivalent to that of the individual electrode 34.

A plurality of the individual electrodes 34 are individually electrically connected to the control unit 14 (see FIG. 1) via the signal transmission unit 26 and wiring, in order to individually control the potentials of each individual electrode 34. When an electric field is applied in the polarization direction of the piezoceramic layer 32 with the individual electrode 34 and the common electrode 33 set to be at different potentials, the portion in the piezoceramic layer 32 to which the electric field is applied operates as an activation part distorted by a piezoelectric effect.

In other words, in the piezoelectric actuator substrate 25, portions of the individual electrode 34, the piezoceramic layer 32, and the common electrode 33 facing the first pressurizing chambers 43 and the second pressurizing chambers 53 function as the displaced elements 38.

Then, unimorph deformation of such displaced elements 38 results in the first pressurizing chambers 43 and the second pressurizing chambers 53 being pressed. Then, the liquid is discharged from the first discharge holes 45 and the second discharge holes 55.

Next, a drive procedure of the liquid discharge head 8 according to the embodiment will be described. The individual electrodes 34 are set to a higher potential (hereinafter, also referred to as high potential) than the common electrode 33 in advance. Then, with the control unit 14, each time a discharge request is made, the individual electrodes 34 are set to the same potential as the common electrode 33 (hereinafter referred to as low potential), and then are again set to the high potential at a predetermined timing.

Thus, at the timing when the individual electrodes 34 shift to the low potential, the piezoceramic layers 31 and 32 return to their original shape, and the volume of the first pressurizing chambers 43 and second pressurizing chambers 53 increases over that in the initial state, that is, the state with the high potential.

In this process, negative pressure is applied to the first pressurizing chamber 43 and the second pressurizing chamber 53. As a result, liquid in the supply manifold 40 is sucked into the interior of the first pressurizing chamber 43 and the second pressurizing chamber 53.

Then, the piezoceramic layers 31 and 32 deform so as to protrude toward the first pressurizing chamber 43 and the second pressurizing chamber 53 at the timing when the individual electrodes 34 are again set to the high potential.

In other words, the first pressurizing chamber 43 and the second pressurizing chamber 53 have positive pressure as a result of the volume of the first pressurizing chamber 43 and the second pressurizing chamber 53 decreasing. Thus, the pressure of the liquid inside the first pressurizing chamber 43 and the second pressurizing chamber 53 rises, and droplets are discharged from the first discharge holes 45 and the second discharge holes 55.

In other words, the control unit 14 supplies a drive signal including pulses based on the high potential to the individual electrode 34 to discharge the droplets from the first discharge holes 45 and the second discharge holes 55. The pulse width need only be an acoustic length (AL), corresponding to the length of time required for pressure waves to propagate from the first aperture 41 to the first discharge holes 45 (or from the second aperture 52 to the second discharge holes 55).

With this configuration, when the inside of the first pressurizing chambers 43 and the second pressurizing chambers 53 transition from the negative pressure state to the positive pressure state, the pressures under the states are combined, so that the droplets can be discharged with higher pressure.

For gradient printing, the gradient is expressed based on the number of droplets continuously discharged from the first discharge holes 45 and the second discharge holes 55, that is, the amount (volume) of droplets adjusted based on the number of times the droplets are discharged. Thus, the droplets are discharged by a number of times corresponding to the designated gradient to be expressed, through the first discharge holes 45 and the second discharge holes 55 corresponding to the designated dot region.

Generally, when the liquid is continuously discharged, the interval between the pulses supplied for discharging the droplets may be designated as AL. As a result, periods match between a residual pressure wave of the pressure produced for the previous discharging of droplets and the pressure wave of the pressure produced for the subsequent discharging of the droplets.

Thus, the residual pressure wave and the pressure wave are superimposed, whereby the droplets can be discharged with a higher pressure. Note that in this case, the later discharging involves a higher speed of the droplets and a closer distance between the landing points of the plurality of droplets.

Various Modifications of Head Main Body

Figure 7:
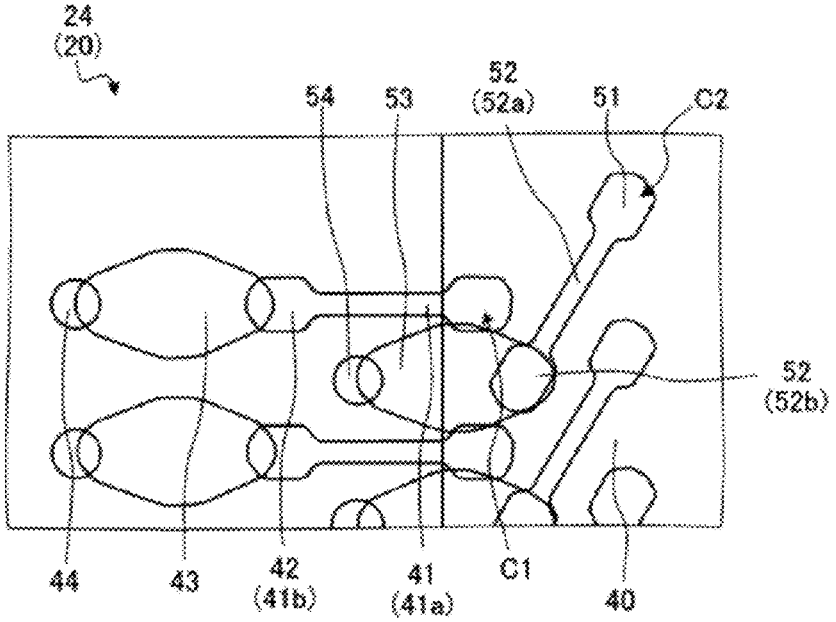
FIG. 7 is an enlarged plane perspective view of a part of a head main body according to a first modification of the embodiment.

Various modifications of the head main body 20 according to the embodiment will be described with reference to FIGS. 7 to 13. FIG. 7 is an enlarged plane perspective view of a part of a head main body 20 according to a first modification of the embodiment.

Note that, in the various modifications below, redundant explanations are omitted, with parts that are the same as those in the embodiment described above denoted by the same reference numerals.

As illustrated in FIG. 7, in the flow channel member 24 of the head main body 20 according to the first modification, the position of the first individual flow channel C1 is different from that in the embodiment. Specifically, the first individual flow channel C1 is located so as to be entirely separated from the supply manifold 40 as compared with the embodiment.

In the first modification, there is a portion where the first aperture 41 of the first individual flow channel C1 and the second pressurizing chamber 53 of the second individual flow channel C2 overlap in plan view. As a result, the first individual flow channel C1 and the second individual flow channel C2 can be formed in the flow channel member 24 with high space efficiency.

Thus, with the first modification, even when a large number of the first discharge holes 45 and the second discharge holes 55 are provided, the flow channel member 24 can be downsized, whereby the head main body 20 can be downsized.

Furthermore, in the first modification, a plate in which the second aperture 52 is formed is located below the second pressurizing chamber 53, whereby rigidity directly below the second pressurizing chamber 53 can be guaranteed.

Figure 8:
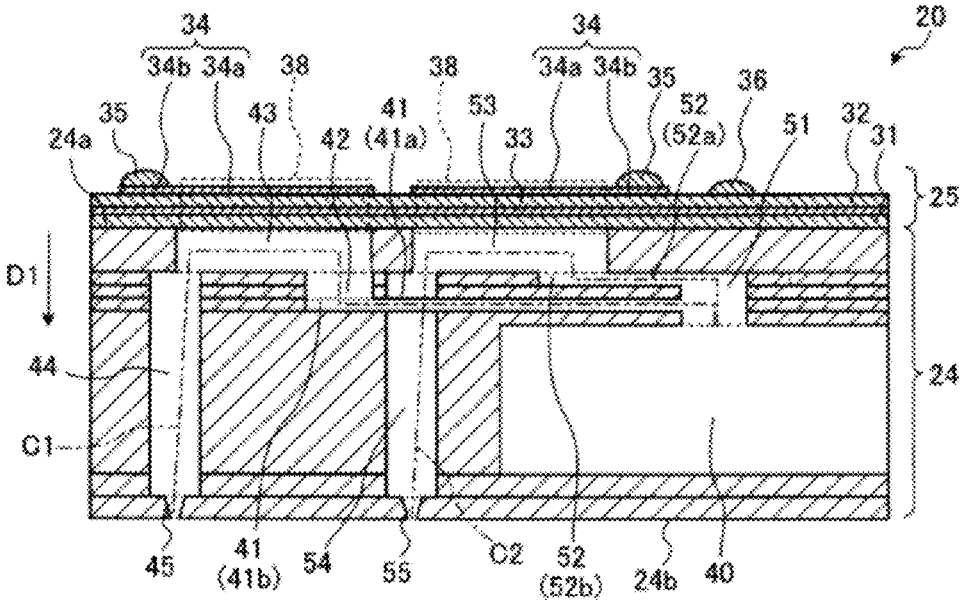
FIG. 8 is a schematic cross-sectional view of a part of a head main body according to a second modification of the embodiment.
Figure 9:
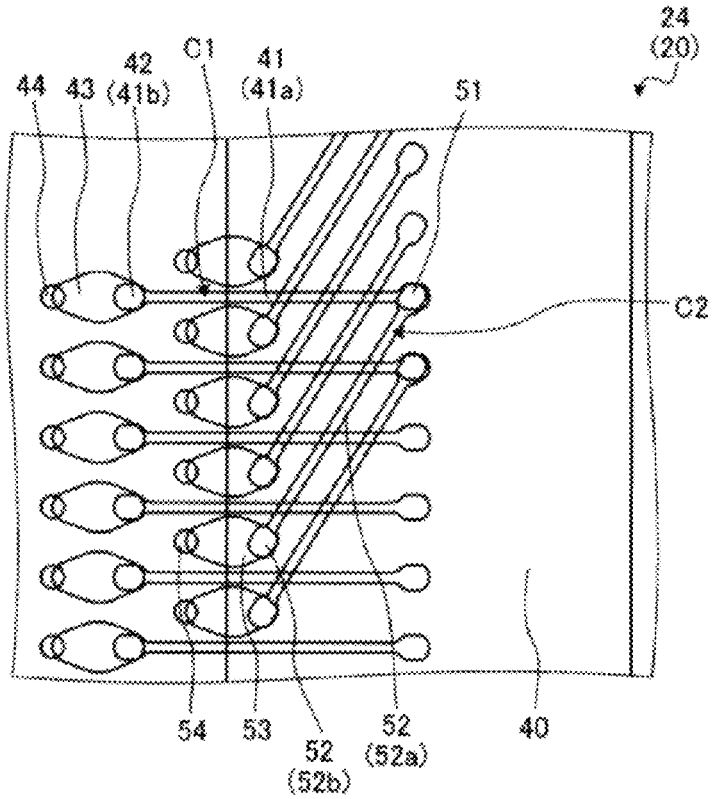
FIG. 9 is an enlarged plane perspective view of a part of the head main body according to the second modification of the embodiment.

FIG. 8 is a schematic cross-sectional view of a part of the head main body 20 according to a second modification of the embodiment, and FIG. 9 is an enlarged plane perspective view of a part of the head main body 20 according to the second modification of the embodiment.

As illustrated in FIG. 8 and FIG. 9, in the second modification, an upstream portion of the first aperture 41 in the first individual flow channel C1 overlaps the second connection flow channel 51 of the second individual flow channel C2. In other words, the first aperture 41 and the second aperture 52 are both connected to the supply manifold 40 via the second connection flow channel 51 in common. As a result, the number of connection portions connected to the first individual flow channel C1 and the second individual flow channel C2 can be reduced in the supply manifold 40.

Thus, with the second modification, the connection portion between the supply manifold 40 and the first individual flow channel C1 and the second individual flow channel C2 can be simplified. Furthermore, with the second modification, the number of connection portions can be reduced, whereby the rigidity of the plate in which such connection portions are formed can be guaranteed.

Figure 10:
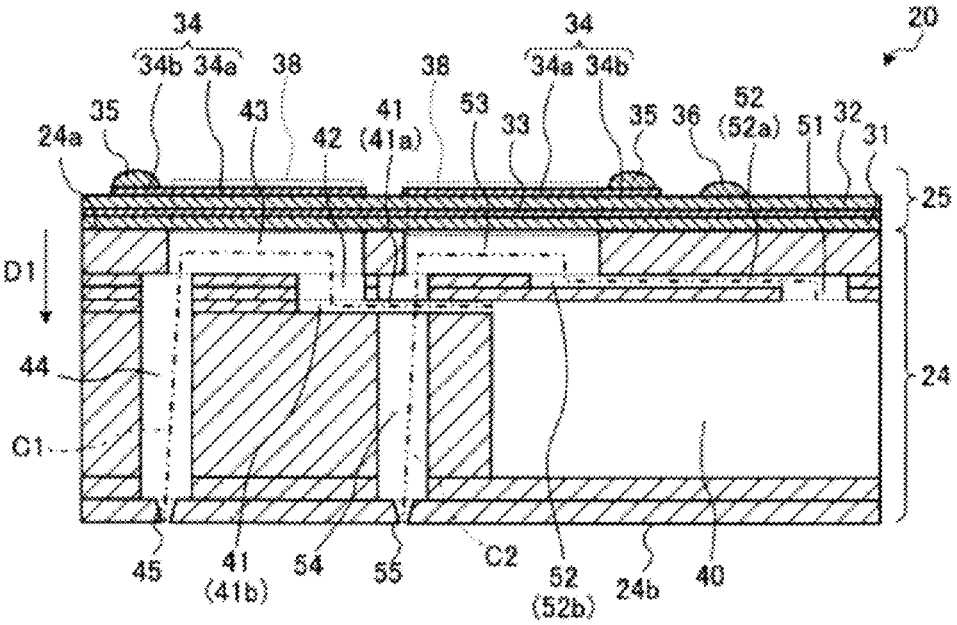
FIG. 10 is a schematic cross-sectional view of a part of a head main body according to a third modification of the embodiment.
Figure 11:
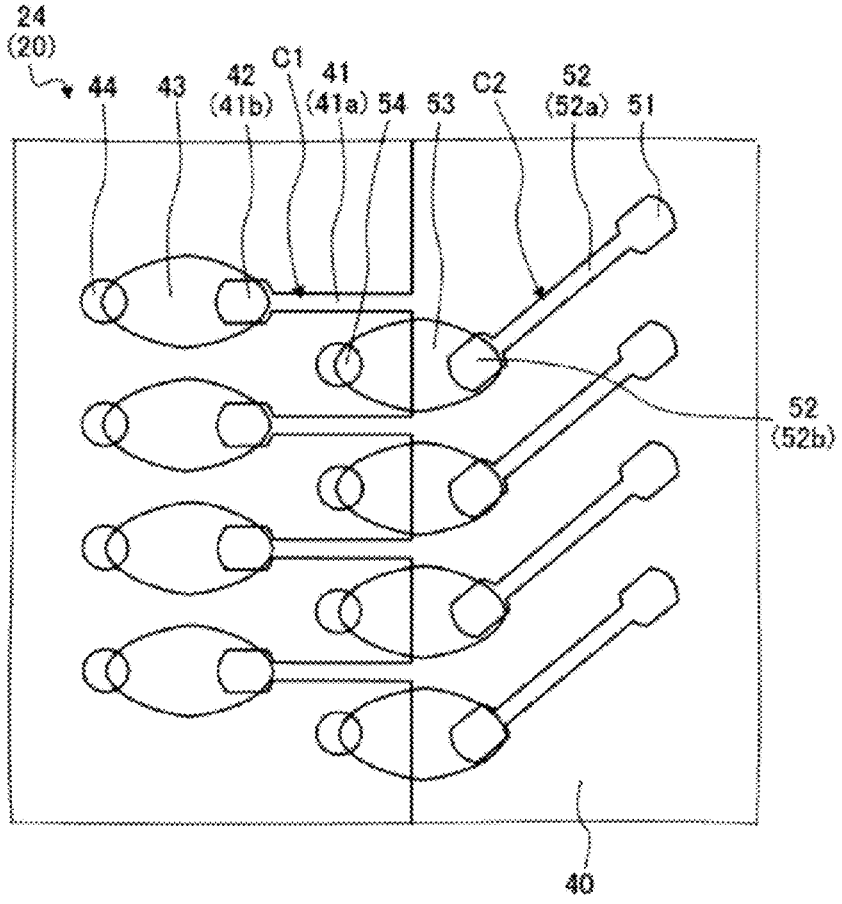
FIG. 11 is an enlarged plan view of a part of the head main body according to the third modification of the embodiment.

FIG. 10 is a schematic cross-sectional view of a part of the head main body 20 according to a third modification of the embodiment, and FIG. 11 is an enlarged plane perspective view of a part of the head main body 20 according to the third modification of the embodiment.

As illustrated in FIG. 10 and FIG. 11, in the flow channel member 24 of the head main body 20 according to the third modification, the first individual flow channel C1 is connected to the side surface of the supply manifold 40, and the second individual flow channel C2 is connected to the upper surface of the supply manifold 40. As a result, the first individual flow channel C1 and the second individual flow channel C2 can be formed in the flow channel member 24 with high space efficiency. Specifically, the number of plates between the second pressurizing chamber 53 and the supply manifold 40 can be reduced from that in the configuration of the embodiment illustrated in FIG. 5, whereby downsizing can be achieved. Furthermore, the connection portion between the supply manifold 40 and the first individual flow channel C1 can be simplified.

Thus, according to the third modification, even when a large number of the first discharge holes 45 and the second discharge holes 55 are provided, the flow channel member 24 can be downsized, whereby the head main body 20 can be downsized.

Figure 12:
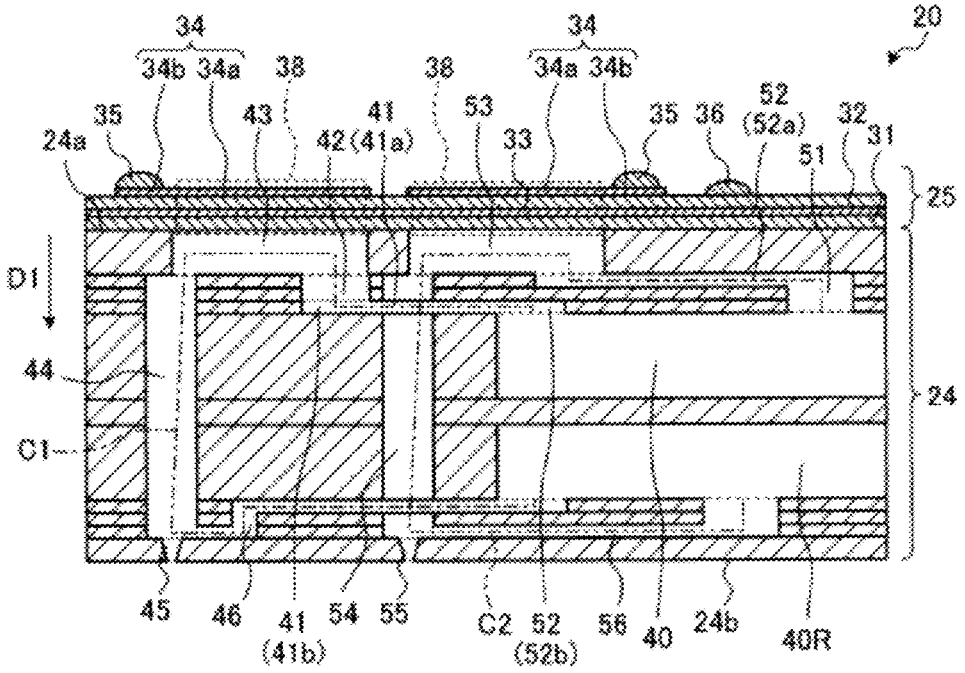
FIG. 12 is a schematic cross-sectional view of a part of a head main body according to a fourth modification of the embodiment.
Figure 13:
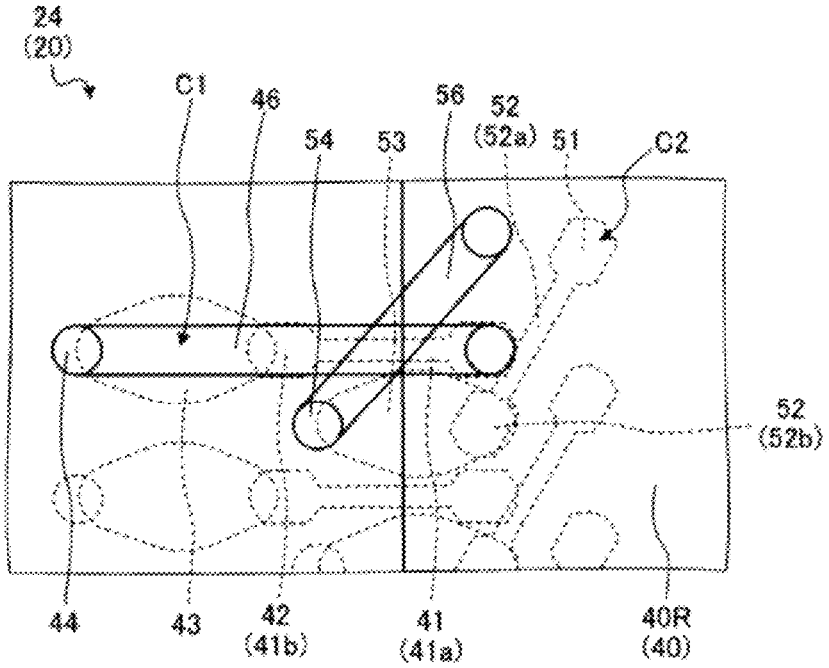
FIG. 13 is an enlarged plane perspective view of a part of the head main body according to the fourth modification of the embodiment.

FIG. 12 is a schematic cross-sectional view of a part of the head main body 20 according to a fourth modification of the embodiment, and FIG. 13 is an enlarged plane perspective view of a part of the head main body 20 according to the fourth modification of the embodiment.

As illustrated in FIG. 12, the flow channel member 24 according to the fourth modification is provided with a collection manifold 40R, in addition to the supply manifold 40. The collection manifold 40R is provided to face the supply manifold 40 in the first direction D1. In the fourth modification, the first individual flow channel C1 and the second individual flow channel C2 are each connected to the collection manifold 40R.

Specifically, a first collection flow channel 46 branches from the first vertical flow channel 44 located on the upstream side of the first discharge holes 45, and the first collection flow channel 46 is connected to the collection manifold 40R. A second collection flow channel 56 branches from the second vertical flow channel 54 located on the upstream side of the second discharge holes 55, and the second collection flow channel 56 is connected to the collection manifold 40R.

Thus, in the fourth modification, the first individual flow channel C1 includes the first aperture 41, the first connection flow channel 42, the first pressurizing chamber 43, the first vertical flow channel 44, and the first collection flow channel 46. In the fourth modification, the second individual flow channel C2 includes the second connection flow channel 51, the second aperture 52, the second pressurizing chamber 53, the second vertical flow channel 54, and the second collection flow channel 56.

When bubbles are contained in the liquid supplied from the supply manifold 40 through the first individual flow channel C1, the bubbles are collected in the collection manifold 40R through the first collection flow channel 46.

Similarly, when bubbles are contained in the liquid supplied from the supply manifold 40 through the second individual flow channel C2, the bubbles are collected in the collection manifold 40R through the second collection flow channel 56.

Thus, in the fourth modification, the collection manifold 40R, the first collection flow channel 46, and the second collection flow channel 56 are provided, so that bubbles can be prevented from remaining in the first vertical flow channel 44 or the second vertical flow channel 54. Thus, with the fourth modification, a negative impact of the remaining bubbles on the pressure waves propagating from the first pressurizing chamber 43 or the second pressurizing chamber 53 can be suppressed.

Furthermore, in the fourth modification, as illustrated in FIG. 13, the first collection flow channel 46 and the second collection flow channel 56 have an overlapping portion in plan view. Furthermore, as illustrated in FIG. 12, the first collection flow channel 46 and the second collection flow channel 56 are disposed at different heights. As a result, in the fourth modification, the first individual flow channel C1 and the second individual flow channel C2 can be formed in the flow channel member 24 with high space efficiency.

In the fourth modification, in plan view, preferably, the first pressurizing chamber 43 is located farther from the supply manifold 40 than the second pressurizing chamber 53, and the first collection flow channel 46 is located closer to the first surface 24*a* than the second collection flow channel 56.

With this configuration, in the fourth modification, the first collection flow channel 46 and the second collection flow channel 56 can be formed in the flow channel member 24 with even higher space efficiency.

Thus, with the fourth modification, even when a large number of the first discharge holes 45 and the second discharge holes 55 are provided, the flow channel member 24 can be downsized, whereby the head main body 20 can be downsized.

The first collection flow channel 46 is connected to the first discharge hole 45 side of the first vertical flow channel 44 in the first direction D1, and the second collection flow channel 56 is connected to the second discharge hole 55 side of the second vertical flow channel 54 in the first direction D1. As a result, the liquid near the first discharge holes 45 and the second discharge holes 55 can be collected, whereby the first discharge holes 45 and the second discharge holes 55 are less likely to become clogged.

The first collection flow channel 46 and the second collection flow channel 56 are disposed at the same height in the first direction D1. In other words, the height at which the first collection flow channel 46 branches from the first vertical flow channel 44 and the height at which the second collection flow channel 56 branches from the second vertical flow channel 54 are the same. As a result, the first collection flow channel 46 and the second collection flow channel 56 can impose similar effects on the first vertical flow channel 44 and the second vertical flow channel 54, whereby the droplets can be discharged with similar characteristics from the first discharge hole 45 and the second discharge hole 55.

Although embodiments of the present disclosure are described above, the present disclosure is not limited to the embodiments described above, and various modifications can be made without departing from the spirit thereof. For example, in the example described in the above embodiment, the flow channel member 24 includes a plurality of stacked plates. However, the flow channel member 24 is not limited to the configuration where a plurality of plates are stacked.

For example, the flow channel member 24 may be configured with the supply manifold 40, the first individual flow channel C1, the second individual flow channel C2, and the like formed by etching.

As described above, the liquid discharge head 8 according to the embodiment includes the flow channel member 24 including the first surface 24*a* and the second surface 24*b* located opposite to the first surface 24*a*, and the pressing unit (displaced elements 38) located on the first surface 24*a*. The flow channel member 24 includes a first discharge hole 45 and a second discharge hole 55 located in the second surface 24*b*, a first individual flow channel C1 connected to the first discharge hole 45; a first pressurizing chamber 43 located more on an upstream side than the first discharge hole 45 in the first individual flow channel C1; a second individual flow channel C2 connected to the second discharge hole 55; a second pressurizing chamber 53 located more on an upstream side than the second discharge hole 55 in the second individual flow channel C2; and a manifold (supply manifold 40) commonly connected to an upstream side of first individual flow channel C1 and an upstream side of the second individual flow channel C2. The first individual flow channel C1 and the second individual flow channel C2 have an overlapping portion in plan view. With this configuration, the head main body 20 can be downsized.

In the liquid discharge head 8 according to the embodiment, the first individual flow channel C1 includes the first aperture 41 connecting the first pressurizing chamber 43 and the manifold (supply manifold 40) to each other, the second individual flow channel C2 includes the second aperture 52 connecting the second pressurizing chamber 53 and the manifold (supply manifold 40) to each other, and the first aperture 41 and the second aperture 52 have an overlapping portion in plan view. With this configuration, the liquid can be efficiently discharged from the first discharge hole 45 and the second discharge hole 55, and the first individual flow channel C1 and the second individual flow channel C2 can be formed in the flow channel member 24 with high space efficiency.

In the liquid discharge head 8 according to the embodiment, in plan view, the first pressurizing chamber 43 is located farther from the manifold (supply manifold 40) than the second pressurizing chamber 53, and the second aperture 52 is located closer to the first surface 24*a* than the first aperture 41. With this configuration, the first individual flow channel C1 can be formed in the flow channel member 24 with even higher space efficiency.

In the liquid discharge head 8 according to the embodiment, the first individual flow channel C1 includes the first aperture 41 connecting the first pressurizing chamber 43 and the manifold (supply manifold 40) to each other, the second individual flow channel C2 includes the second aperture 52 connecting the second pressurizing chamber 53 and the manifold (supply manifold 40) to each other, the second pressurizing chamber 53 and the second aperture 52 are located closer to the first surface 24*a* than the first aperture 41, and the second pressurizing chamber 53 and the first aperture 41 have an overlapping portion in plan view. With this configuration, the head main body 20 can be downsized, and the rigidity directly below the second pressurizing chamber 53 can be guaranteed.

In the liquid discharge head 8 according to the embodiment, when the direction from the first surface 24*a* toward the second surface 24*b* is defined as the first direction D1, the first individual flow channel C1 includes the first connection flow channel 42 connecting the first pressurizing chamber 43 and the first aperture 41 to each other in the first direction D1, the second individual flow channel C2 includes the second connection flow channel 51 connecting the second aperture 52 and the manifold (supply manifold 40) to each other in the first direction D1. The volume of the second pressurizing chamber 53 is larger than the volume of the first pressurizing chamber 43. With this configuration, the characteristics of discharging as a result of application of pressure from the displaced element 38 to the first pressurizing chamber 43 and the characteristics of discharging as a result of application of pressure to the second pressurizing chamber 53 from the displaced element 38 can be equalized.

In the liquid discharge head 8 according to the embodiment, when the direction from the first surface 24*a* toward the second surface 24*b* is defined as the first direction D1, the second individual flow channel C2 includes the second connection flow channel 51 connecting the second aperture 52 and the manifold (supply manifold 40) to each other in the first direction D1, and the upstream portion of the first aperture 41 and the second connection flow channel 51 overlap in plan view.

With this configuration, the connection portion between the supply manifold 40 and the first individual flow channel C1 and the second individual flow channel C2 can be simplified.

In the liquid discharge head 8 according to the embodiment, the first individual flow channel C1 is connected to the side surface of the manifold (supply manifold 40), and the second individual flow channel C2 is connected to the upper surface of the manifold (supply manifold 40). With this configuration, the head main body 20 can be downsized, and the connection portion between the supply manifold 40 and the first individual flow channel C1 can be simplified.

In the liquid discharge head 8 according to the embodiment, the first individual flow channel C1 includes the first collection flow channel 46 branched from a portion more on the upstream side than the first discharge hole 45, and the second individual flow channel C2 includes the second collection flow channel 56 branched from a portion more on the upstream side than the second discharge hole 55. With this configuration, a negative impact of the remaining bubbles on the pressure wave propagating from the first pressurizing chamber 43 or the second pressurizing chamber 53 can be suppressed.

In the liquid discharge head 8 according to the embodiment, in plan view, the first pressurizing chamber 43 is located farther from the manifold (supply manifold 40) than the second pressurizing chamber 53, and the first collection flow channel 46 is located closer to the first surface 24*a* than the second collection flow channel 56. With this configuration, the first collection flow channel 46 and the second collection flow channel 56 can be formed in the flow channel member 24 with even higher space efficiency.

The recording apparatus (printer 1) according to the embodiment includes the liquid discharge head 8, the conveying unit (conveying rollers 6) configured to convey the recording medium (printing sheet P) to the liquid discharge head 8, and the control unit 14 configured to control the liquid discharge head 8 as described above. With this configuration, the printer 1 with the head main body 20, which is downsized, can be achieved.

In addition, the recording apparatus (printer 1) according to the embodiment includes the liquid discharge head 8, and the applicator 4 configured to apply the coating agent on the recording medium (printing sheet P) as described above. Thus, the printing quality of the printer 1 can be improved.

In addition, the recording apparatus (printer 1) according to the embodiment includes the liquid discharge head 8, and the dryer 10 that dries the recording medium (printing sheet P) as described above. With this configuration, it is possible to suppress the bonding between the printing sheets P rolled while being overlapped with each other, and rubbing of undried liquid, in the collection roller 13.

The disclosed embodiments should be considered as illustrative and not limiting in any point. In fact, the embodiments described above can be embodied in a variety of forms. Omission, replacement, and change can be made in various forms on the above embodiments without departing from the scope and the spirit of the appended claims.

The invention claimed is:

1. A liquid discharge head, comprising:

a pressing unit located on a first surface; and a flow channel member comprising:

the first surface;

a second surface located opposite to the first surface;

a first discharge hole and a second discharge hole located in the second surface;

a first individual flow channel connected to the first discharge hole;

a first pressurizing chamber located more on an upstream side than the first discharge hole in the first individual flow channel;

a second individual flow channel connected to the second discharge hole;

a second pressurizing chamber located more on an upstream side than the second discharge hole in the second individual flow channel; and a manifold commonly connected to an upstream side of the first individual flow channel and an upstream side of the second individual flow channel, wherein the first individual flow channel and the second individual flow channel have an overlapping portion in plan view, and wherein the first individual flow channel comprises a first aperture connecting the first pressurizing chamber and the manifold to each other, the second individual flow channel comprises a second aperture connecting the second pressurizing chamber and the manifold to each other, and the first aperture and the second aperture have an overlapping portion in plan view, or wherein the second pressurizing chamber and the second aperture are located closer to the first surface than the first aperture, and the second pressurizing chamber and the first aperture have an overlapping portion in plan view, or wherein the first individual flow channel is connected to a side surface of the manifold, and the second individual flow channel is connected to an upper surface of the manifold, or wherein the first individual flow channel comprises a first collection flow channel branched from a portion more on the upstream side than the first discharge hole, and the second individual flow channel comprises a second collection flow channel branched from a portion more on the upstream side than the second discharge hole.

2. The liquid discharge head according to claim 1, wherein the first individual flow channel comprises the first aperture connecting the first pressurizing chamber and the manifold to each other, the second individual flow channel comprises the second aperture connecting the second pressurizing chamber and the manifold to each other, the first aperture and the second aperture have the overlapping portion in plan view, the first pressurizing chamber is located farther from the manifold than the second pressurizing chamber in plan view, and the second aperture is located closer to the first surface than the first aperture in plan view.

3. The liquid discharge head according to claim 1, wherein the first individual flow channel comprises the first aperture connecting the first pressurizing chamber and the manifold to each other, the second individual flow channel comprises the second aperture connecting the second pressurizing chamber and the manifold to each other, the first aperture and the second aperture have the overlapping portion in plan view, when a direction from the first surface toward the second surface is defined as a first direction, the first individual flow channel comprises a first connection flow channel connecting the first pressurizing chamber and the first aperture to each other in the first direction, the second individual flow channel comprises a second connection flow channel connecting the second aperture and the manifold to each other in the first direction, and a volume of the second pressurizing chamber is larger than a volume of the first pressurizing chamber.

4. The liquid discharge head according to claim 1, wherein the first individual flow channel comprises the first aperture connecting the first pressurizing chamber and the manifold to each other, the second individual flow channel comprises the second aperture connecting the second pressurizing chamber and the manifold to each other, the first aperture and the second aperture have the overlapping portion in plan view, when a direction from the first surface toward the second surface is defined as a first direction, the second individual flow channel comprises a second connection flow channel connecting the second aperture and the manifold to each other in the first direction, and an upstream portion of the first aperture and the second connection flow channel overlap in plan view.

5. The liquid discharge head according to claim 1, wherein the first individual flow channel comprises the first collection flow channel branched from the portion more on the upstream side than the first discharge hole, the second individual flow channel comprises the second collection flow channel branched from the portion more on the upstream side than the second discharge hole, the first pressurizing chamber is located farther from the manifold than the second pressurizing chamber in plan view, and the first collection flow channel is located closer to the first surface than the second collection flow channel.

6. A recording apparatus comprising:

a liquid discharge head comprising:

a pressing unit located on a first surface; and a flow channel member comprising:

the first surface;

a second surface located opposite to the first surface;

a first discharge hole and a second discharge hole located in the second surface;

a first individual flow channel connected to the first discharge hole;

a first pressurizing chamber located more on an upstream side than the first discharge hole in the first individual flow channel;

a second individual flow channel connected to the second discharge hole;

a second pressurizing chamber located more on an upstream side than the second discharge hole in the second individual flow channel; and a manifold commonly connected to an upstream side of the first individual flow channel and an upstream side of the second individual flow channel, wherein the first individual flow channel and the second individual flow channel have an overlapping portion in plan view;

a conveying unit configured to convey a recording medium to the liquid discharge head; and a control unit configured to control the liquid discharge head, wherein the first individual flow channel comprises a first aperture connecting the first pressurizing chamber and the manifold to each other, the second individual flow channel comprises a second aperture connecting the second pressurizing chamber and the manifold to each other, and the first aperture and the second aperture have an overlapping portion in plan view, or wherein the second pressurizing chamber and the second aperture are located closer to the first surface than the first aperture, and the second pressurizing chamber and the first aperture have an overlapping portion in plan view, or wherein the first individual flow channel is connected to a side surface of the manifold, and the second individual flow channel is connected to an upper surface of the manifold, or wherein the first individual flow channel comprises a first collection flow channel branched from a portion more on the upstream side than the first discharge hole, and the second individual flow channel comprises a second collection flow channel branched from a portion more on the upstream side than the second discharge hole.

7. A recording apparatus comprising:

an applicator configured to apply a coating agent on a recording medium; and a liquid discharge head comprising:

a pressing unit located on a first surface; and a flow channel member comprising:

the first surface;

a second surface located opposite to the first surface;

a first discharge hole and a second discharge hole located in the second surface;

a first individual flow channel connected to the first discharge hole;

a first pressurizing chamber located more on an upstream side than the first discharge hole in the first individual flow channel;

a second individual flow channel connected to the second discharge hole;

a second pressurizing chamber located more on an upstream side than the second discharge hole in the second individual flow channel; and a manifold commonly connected to an upstream side of the first individual flow channel and an upstream side of the second individual flow channel, wherein the first individual flow channel and the second individual flow channel have an overlapping portion in plan view.

8. A recording apparatus comprising:

a dryer configured to dry a recording medium; and a liquid discharge head comprising:

a pressing unit located on a first surface; and a flow channel member comprising:

the first surface;

a second surface located opposite to the first surface;

a first discharge hole and a second discharge hole located in the second surface;

a first individual flow channel connected to the first discharge hole;

a first pressurizing chamber located more on an upstream side than the first discharge hole in the first individual flow channel;

a second individual flow channel connected to the second discharge hole;

a second pressurizing chamber located more on an upstream side than the second discharge hole in the second individual flow channel; and a manifold commonly connected to an upstream side of the first individual flow channel and an upstream side of the second individual flow channel, wherein the first individual flow channel and the second individual flow channel have an overlapping portion in plan view, and wherein the first individual flow channel comprises a first aperture connecting the first pressurizing chamber and the manifold to each other, the second individual flow channel comprises a second aperture connecting the second pressurizing chamber and the manifold to each other, and the first aperture and the second aperture have an overlapping portion in plan view, or wherein the second pressurizing chamber and the second aperture are located closer to the first surface than the first aperture, and the second pressurizing chamber and the first aperture have an overlapping portion in plan view, or wherein the first individual flow channel is connected to a side surface of the manifold, and the second individual flow channel is connected to an upper surface of the manifold, or wherein the first individual flow channel comprises a first collection flow channel branched from a portion more on the upstream side than the first discharge hole, and the second individual flow channel comprises a second collection flow channel branched from a portion more on the upstream side than the second discharge hole.

9. The recording apparatus according to claim 7, wherein the first individual flow channel comprises a first aperture connecting the first pressurizing chamber and the manifold to each other, the second individual flow channel comprises a second aperture connecting the second pressurizing chamber and the manifold to each other, and the first aperture and the second aperture have an overlapping portion in plan view, or wherein the second pressurizing chamber and the second aperture are located closer to the first surface than the first aperture, and the second pressurizing chamber and the first aperture have an overlapping portion in plan view, or wherein the first individual flow channel is connected to a side surface of the manifold, and the second individual flow channel is connected to an upper surface of the manifold, or wherein the first individual flow channel comprises a first collection flow channel branched from a portion more on the upstream side than the first discharge hole, and the second individual flow channel comprises a second collection flow channel branched from a portion more on the upstream side than the second discharge hole.

* * * * *